United States Patent [19]

DeLuca

[11] 4,222,532

[45] Sep. 16, 1980

[54] ROLL HOLDER

[75] Inventor: Raymond F. DeLuca, Stamford, Conn.

[73] Assignee: Georgia-Pacific Corporation, Portland, Oreg.

[21] Appl. No.: 28,658

[22] Filed: Apr. 10, 1979

[51] Int. Cl.[2] ..... B65H 19/00

[52] U.S. Cl. ..... 242/55.2

[58] Field of Search ..... 242/55.2, 55.3, 55.53, 242/55.54

[56] References Cited

U.S. PATENT DOCUMENTS

| | | | |
|---|---|---|---|
| 2,525,992 | 10/1950 | Wynn | 242/55.2 X |
| 2,809,790 | 10/1957 | Kirchel | 242/55.2 |
| 3,022,957 | 2/1962 | Blunt | 242/55.2 |
| 3,249,313 | 5/1966 | Hackney | 242/55.2 |
| 4,103,838 | 8/1978 | Young | 242/55.2 |

*Primary Examiner*—Edward J. McCarthy

*Attorney, Agent, or Firm*—Schuyler, Birch, McKie & Beckett

[57] ABSTRACT

A roll holder is disclosed having a pair of spaced roll supporting means, wherein one of the supporting means comprises a movable arm pivotable about an oblique axis between a roll supporting position and a roll loading position.

15 Claims, 4 Drawing Figures

ROLL HOLDER

BACKGROUND OF THE INVENTION

1. Field of the Invention

This invention relates to roll holders and, more particularly, to roll holders for rotatably and interchangeably supporting rolls of wound material.

2. Description of the Prior Art

The prior art is replete with a wide variety of holders for interchangeably and rotatably supporting rolls of wound material. Many of these are designed for the dispensing of sheet material from a wound roll, such as toilet or paper towels. In holders of this type, the roll is usually supported by a pair of spaced roll supporting elements which flank the roll on its opposite ends and engage the roll core. One of the roll supporting elements usually comprises a movable arm pivotable between a roll supporting position adjacent one end of the roll and a roll loading position spaced from the roll. The pivot axis is usually disposed normal to the axis of the roll core. A complex spring-loaded latching mechanism is usually required to maintain the movable arm in its roll supporting position. It is often a cumbersome task to properly position the roll to be supported and manipulate the spring-loaded movable arm and locking means to engage and support the roll.

In one type of paper roll holder disclosed by Blunt in U.S. Pat. No. 3,022,957, an elongated roll supporting spindle is positioned between fixed support arms. The spindle is adapted to extend completely through the core of the paper roll, and is hingedly connected at one end to one of the arms along an axis which is oblique to the roll axis. The other arm has a cradle for supporting the free end of the spindle. The spindle may thus be swung upwardly and forwardly to change rolls. While this holder does obviate some of the complexities and shortcomings of the other types of prior art holders, it still presents some difficulties in unloading spent cores and loading fresh rolls. In this regard, the spent core must be manually withdrawn from the spindle while the spindle is held in an elevated position. In addition, the fixed arms must be unusually widely spaced to provide clearance for a full roll as it swings into position. This arrangement is most unsatisfactory for dispensers such as those which support and dispense paper towels from single or multiple rolls, wherein accurate roll positioning is most important for dispenser mechanism operation.

SUMMARY OF THE INVENTION

It is therefore an object of the present invention to obviate the above-noted shortcomings of the prior art by providing a roll holder of simple and inexpensive construction which can be easily manipulated in loading a fresh roll of wound material into the holder.

Another object of the invention is to provide such a holder wherein the simple pivoting motion of one supporting element will effectively engage and accurately support a roll of wound material without the need for a complex spring-loaded latch mechanism.

Another object of the invention is to provide such a holder wherein the weight of the roll alone maintains the movable element of the holder in its roll supporting position.

These and other objects of the invention are accomplished in a holder for supporting a roll of wound material for rotation about its wound axis including a pair of spaced roll supporting means flanking the roll on opposite ends thereof, one of the roll supporting means comprising a movable arm pivotable between a roll supporting position adjacent one end of the roll and a roll loading position spaced therefrom, wherein the movable arm is pivoted for movement about an axis oblique to the wound axis between the roll supporting position and a roll loading position spaced axially and transversely from the roll supporting position.

The invention is particularly well adapted for supporting a roll of wound material having a core for rotation about a generally horizontally core axis adjacent a supporting surface, the holder including a pair of spaced, generally horizontally extending core engaging arms, one of the arms being pivotable about an oblique axis.

BRIEF DESCRIPTION OF THE DRAWINGS

The novel features of the invention are set out with particularity in the appended claims, but the invention will be understood more fully and clearly from the following detailed description of a preferred embodiment of the invention as set forth in the accompanying drawings, in which:

DESCRIPTION OF THE INVENTION

Figure 1:
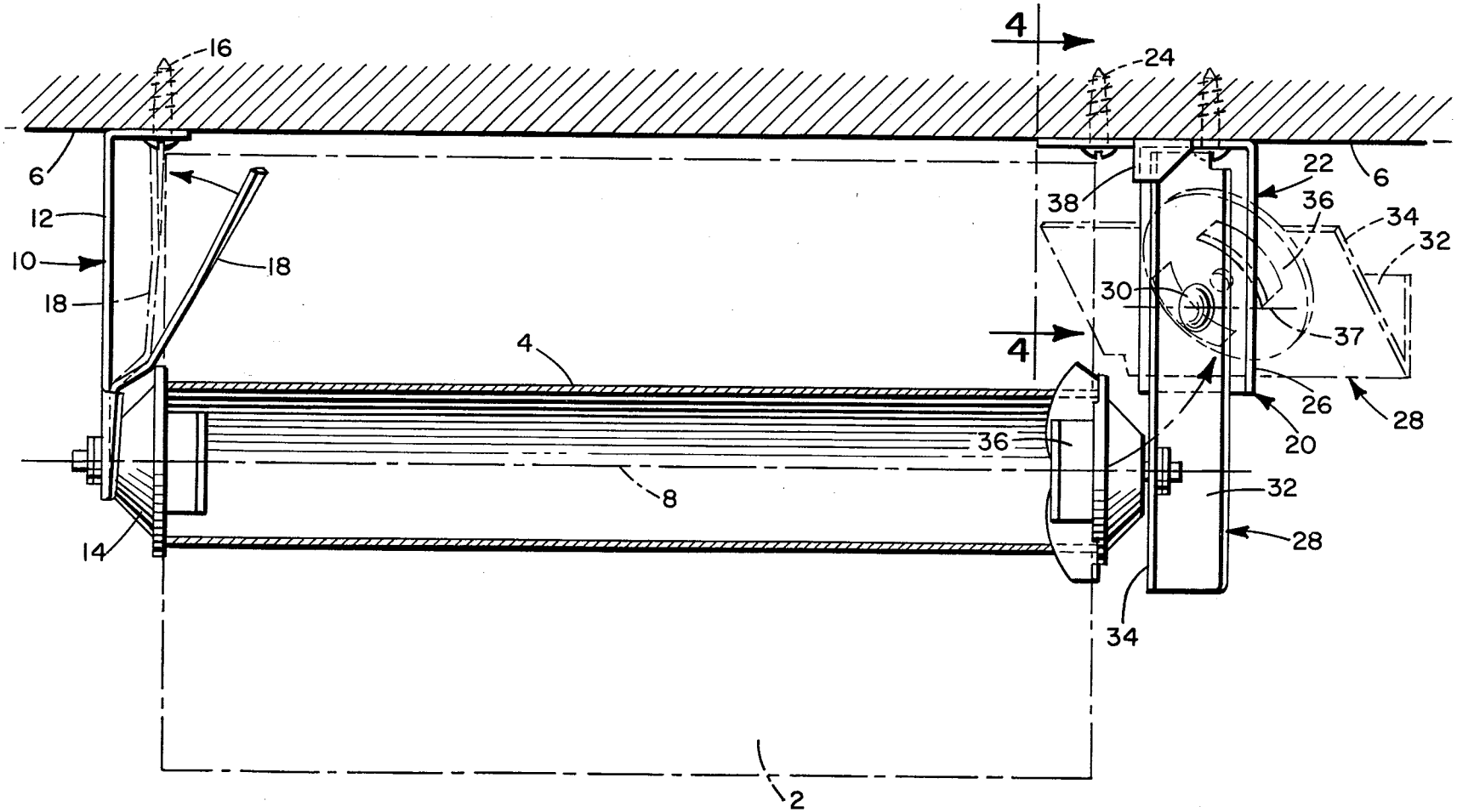
FIG. 1 is a top plan view, partly in section, of the holder according to the invention.

In the description of the preferred embodiment of the invention that follows, the holder is described as one which supports a roll of wound material for rotation about a generally horizontal axis. It is to be understood, however, that the holder of the invention can be used a support a roll for rotation about an axis which is other than horizontal.

Referring to the Figures, a roll 2 of wound material, such as paper towels, having a paper or cardboard core 4 can be supported for rotation about a generally horizontal core axis 8 adjacent a supporting surface 6 by a fixed arm assembly 10 and a movable arm assembly 20. Supporting surface 6 may be a wall, partition or the like, or an interior panel of a paper towel dispenser housing. Fixed arm assembly 10 comprises a generally L-shaped bracket 12 to which a core engaging spindle 14 is rotatably mounted. Arm 12 is secured to supporting surface 6 by means of screws 16 or similar fasteners. Arm 12 also carries a leaf spring 18 which bears against the edge of roll 2 (shown in phantom in FIG. 1) and acts as a brake to prevent the free spinning of the roll and the undesirable dispensing of an excess number of towels.

Movable arm assembly 20 comprises a generally L-shaped fixed bracket 22 which is secured to supporting surface 6 by means of screws 24 or similar fasteners. The outwardly extending leg 26 of bracket 22 is disposed at an oblique angle to the axis of rotation 8 of roll 2 (See FIG. 2). A movable flanged arm 28 having a V-shaped cross-section is pivotally attached to leg 26 of bracket 22 by means of a rivet 30 or other pivotal connection, the rivet passing through one flange 32 of arm 28. The other flange 34 of arm 28 rotatably supports a core-engaging spindle 36. Arm 28 is therefore pivotable about an oblique axis 37 passing through rivet 30.

Bracket 22 is formed with an abutment 38 which overlies the inner free end of flange 34 of arm 28. Abutment 38 acts as a stop to prevent downward pivotal movement of the spindle-carrying end of arm 28 past its roll supporting position, shown in solid lines in the Figures. A protrusion 40 carried by leg 26 of bracket 22 may be provided as a locking means to maintain arm 28 in its roll supporting position, as described more fully below.

Figure 2:
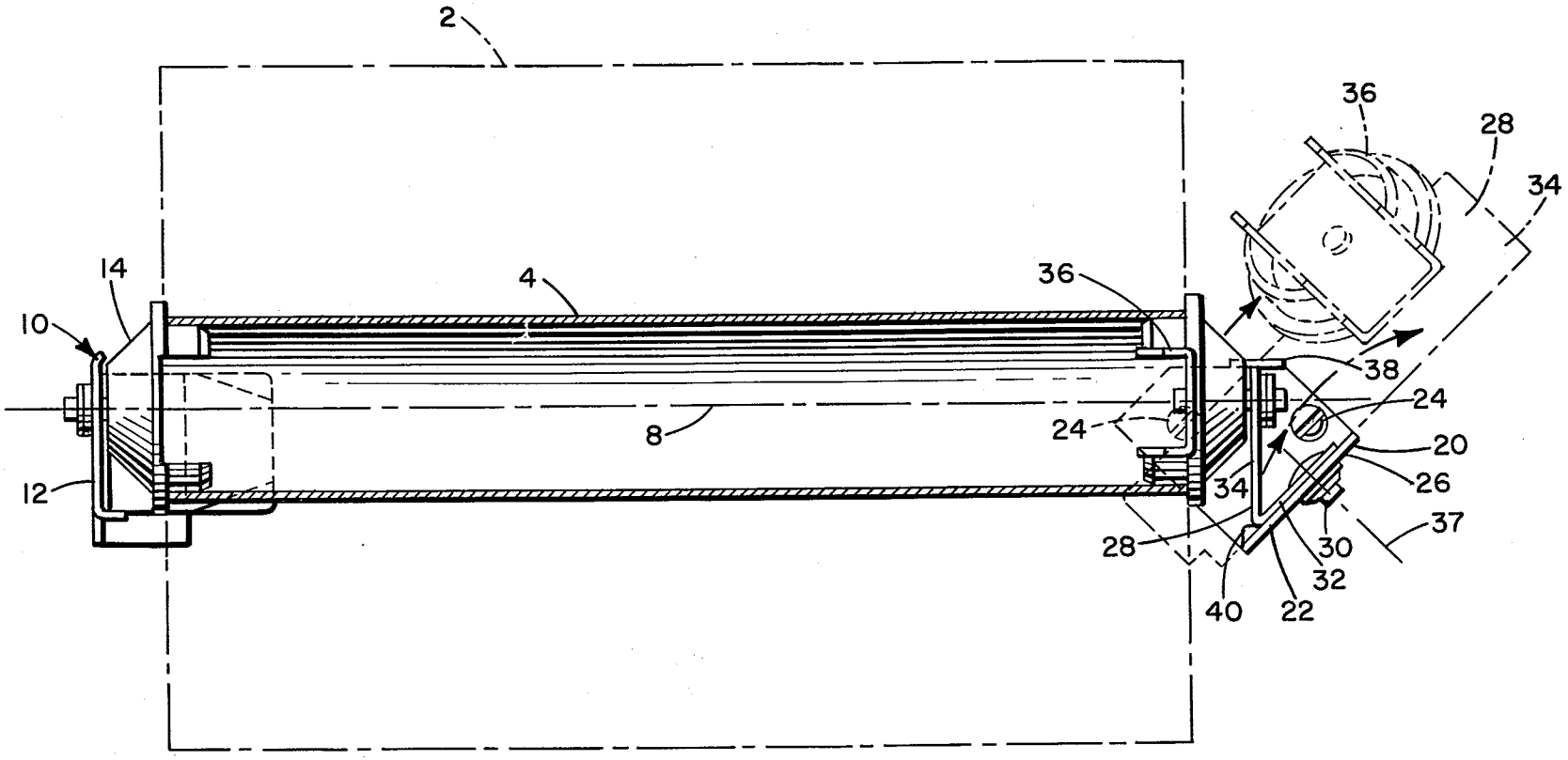
FIG. 2 is a front elevational view thereof, partly in section.
Figure 3:
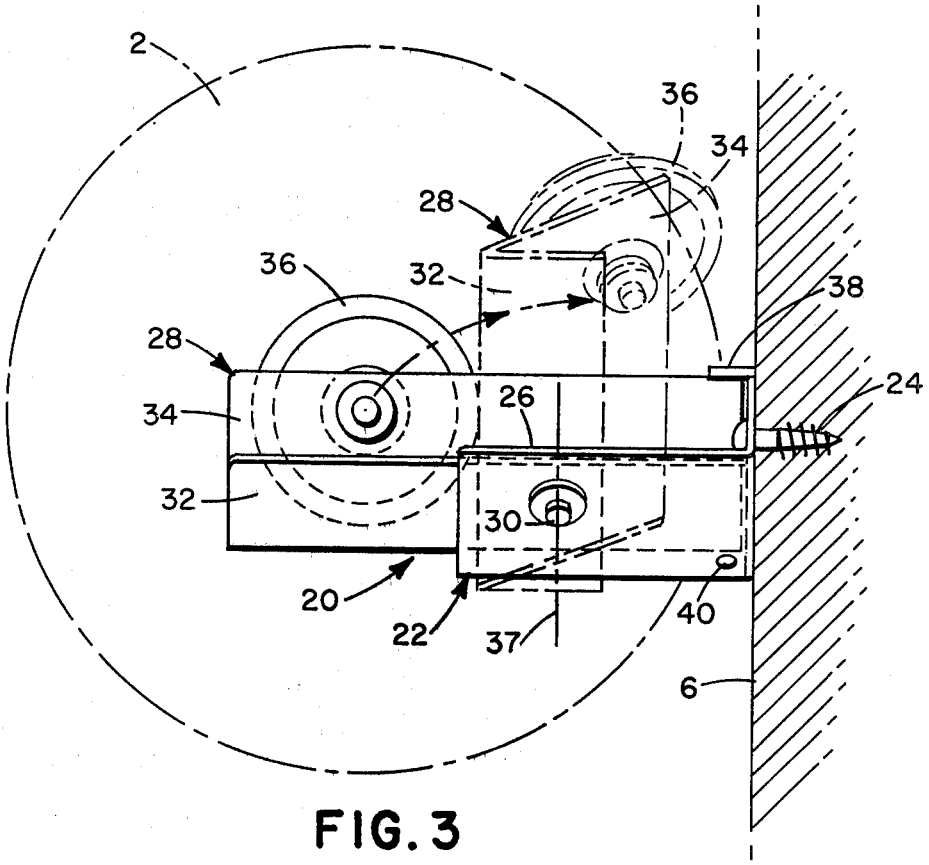
FIG. 3 is a side elevational view of the movable arm assembly.

In use, movable arm 28 is pivoted upwardly about rivet 30 to the elevated position illustrated in phantom in FIGS. 1, 2 and 3. When in this position, spindle 36 is displaced axially away from and above its roll supporting position. With arm 28 in this raised position, the clearance between the two spindles 14 and 36 is greater than the width of the core of a roll of paper towels 2. A spent core simply falls away from the holder, urged by spring 18. A fresh roll is then inserted between the spindles and urged to the left as seen in FIGS. 1 and 2 against leaf spring 18 so that spindle 14 engages core 4. As seen in FIG. 1, the inner free end of arm 28 will support the right-hand end of roll 2 while arm 28 is in its raised position. Arm 28 is then pivoted downwardly so that spindle 36 progressively engages core 4, the inner free end of arm 28 progressively retreating from beneath roll 2 to guide it into engagement with spindle 36. In its roll supporting position, spindle 36 fully engages the core, the inner free end of flange 34 resting against abutment 38. The roll is thus snugly and accurately positioned between the spindles. Since arm 28 cannot rotate downward any further, the weight of roll 2 is sufficient to maintain arm 28 in its roll supporting position.

Figure 4:
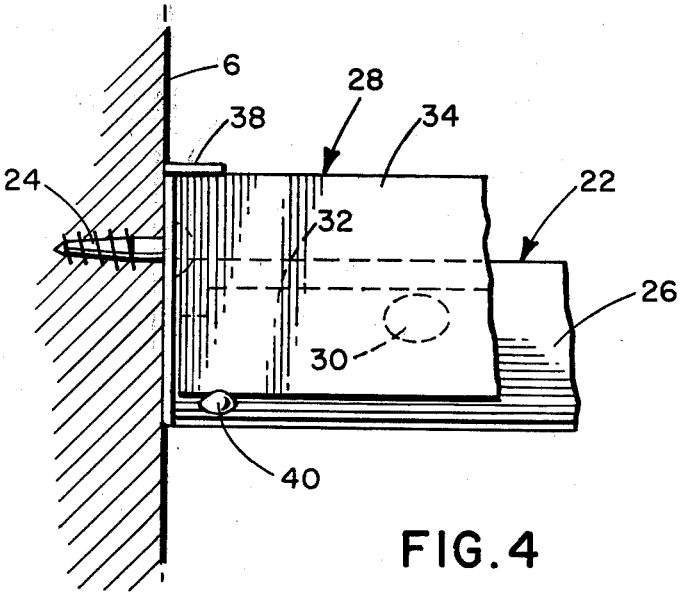
FIG. 4 is a detail view of the movable arm assembly taken along line 4–4 in FIG. 1.

During the descent of the spindle-carrying end of arm 28, the inner free end of arm 28 moves upwardly and outwardly away from roll 2 (see FIGS. 3 and 4). During this movement the inner end of arm 28 encounters protrusion 40. The arm is sufficiently flexible to ride up and over protrusion 40 in frictional engagement therewith. With sufficient downward pressure on the spindle-carrying end of arm 28, the inner end of the arm is forced past protrusion 40 and snaps behind it to be securely locked in position. With a moderate amount of upward force on the spindle-carrying end of arm 28, this locking action can be overcome. Protrusion 40 is also effective to maintain arm 28 in an elevated position during loading.

It can readily be seen that the roll holder of the invention provides a simple, rigid and precise roll supporting structure which can be easily manipulated to remove spent cores and insert fresh rolls of paper. Although the present invention has been illustrated in terms of a preferred embodiment, it will be obvious to one of ordinary skill that numerous modifications may be made without departing from the true spirit and scope of the invention which is to be limited only by the appended claims.

I claim:

1. In a holder for supporting a roll of wound material for rotation about its wound axis including a pair of spaced roll supporting means flanking the roll on opposite ends thereof, one of said roll supporting means comprising a movable arm pivotable between a roll supporting position adjacent one end of the roll and a roll loading position spaced therefrom, the improvement comprising:

said movable arm is pivoted for movement about an axis oblique to said wound axis between said roll supporting positon and a roll loading position spaced axially and transversely from said roll supporting position.

2. A holder according to claim 1 wherein the roll supporting means which comprises said movable arm further comprises a fixed bracket, said movable arm pivotally attached to said fixed bracket for movement about said oblique axis.

3. A holder according to claim 2 wherein said fixed bracket comprises stop means for preventing pivotal movement of said arm past said roll supporting position.

4. A holder according to claim 3 wherein said stop means comprises an abutment in the path of rotation of said arm.

5. A holder according to claim 4 wherein said arm is pivoted intermediate its length and has a roll supporting portion on one side of said pivot and an abutment engaging portion on the other side of said pivot.

6. A holder according to claim 5 wherein the roll supporting means which comprises said movable arm further comprises locking means for locking said arm in its roll supporting position.

7. A holder according to claim 6 wherein said locking means comprises a protrusion on said fixed bracket in the path of said abutment engaging portion, said abutment engaging portion moving over said protrusion in frictional engagement therewith, and clearing and snapping behind said protrusion when in its roll supporting position.

8. A holder according to claim 1 wherein said roll has a core and said roll supporting means each comprises a pivotally mounted core engaging spindle.

9. In a holder for supporting a roll of wound material having a core for rotation about a generally horizontal core axis adjacent a supporting surface, including a pair of spaced, generally horizontally extending core engaging arms flanking the roll position on opposite ends thereof, one of said arms being pivotable between a roll supporting position adjacent one end of the roll and a roll loading position spaced therefrom, the improvement comprising:

said movable arm is pivoted about an axis oblique to said core axis for movement between said roll supporting position and a roll loading position spaced axially from and above said roll supporting position.

10. A holder according to claim 9 further comprising a fixed bracket connected to said supporting surface, said movable arm pivotally attached to said fixed bracket for movement about said oblique axis.

11. A holder according to claim 10 wherein each of said arms includes a pivotally mounted core engaging spindle, and said movable arm comprises an elongated flanged member of V-shaped cross-section, one flange thereof is pivotally attached to said bracket for movement about said oblique axis and the other flange thereof pivotally supports said spindle.

12. A holder according to claim 11 wherein said bracket includes an abutment which engages said movable arm to prevent downward pivotal movement thereof past said roll supporting position.

13. A holder according to claim 12 wherein said movable arm is pivoted intermediate its length and has a spindle-carrying portion on one side of said pivot and an abutment engaging portion on the other side of said pivot, said abutment overlies said abutment engaging portion and engages the upper edge of said other flange when said movable arm is in its roll supporting position.

14. A holder according to claim 13 further comprising locking means on said bracket for locking said movable arm in its roll supporting position.

15. A holder according to claim 14 wherein said locking means comprises a protrusion on said fixed bracket in the path of said abutment engaging portion, said abutment engaging portion moving over said protrusion in frictional engagement therewith, and clearing and snapping behind said protrusion when in its roll supporting position.

* * * * *